US010443225B2

(12) United States Patent
Hoyt

(10) Patent No.: US 10,443,225 B2
(45) Date of Patent: Oct. 15, 2019

(54) TELESCOPING DRUM AUGER EXTENSION TOOL

(71) Applicant: Charles Hoyt, Johnstown, CO (US)

(72) Inventor: Charles Hoyt, Johnstown, CO (US)

( * ) Notice: Subject to any disclaimer, the term of this patent is extended or adjusted under 35 U.S.C. 154(b) by 201 days.

(21) Appl. No.: 15/627,343

(22) Filed: Jun. 19, 2017

(65) Prior Publication Data

US 2018/0051454 A1 Feb. 22, 2018

Related U.S. Application Data

(60) Provisional application No. 62/375,606, filed on Aug. 16, 2016.

(51) Int. Cl.

| | |
|---|---|
| ***E03F 9/00*** | (2006.01) |
| ***B08B 9/045*** | (2006.01) |
| ***B08B 1/00*** | (2006.01) |
| ***E03C 1/302*** | (2006.01) |
| ***B65H 75/36*** | (2006.01) |

(52) U.S. Cl.

CPC ..... *E03F 9/005* (2013.01); *B08B 1/005* (2013.01); *B08B 9/045* (2013.01); *B65H 75/364* (2013.01); *E03C 1/302* (2013.01)

(58) Field of Classification Search

None

See application file for complete search history.

(56) References Cited

U.S. PATENT DOCUMENTS 3,213,473 A * 10/1965 Louis ..... B08B 9/045 15/104.33

8,434,186 B2 * 5/2013 Wildauer ..... E03F 9/005 15/104.33

* cited by examiner

*Primary Examiner* — Eric W Golightly

(74) *Attorney, Agent, or Firm* — Patent Law Offices of Rick Martin, P.C

(57) ABSTRACT

An apparatus for cleaning drains has a drum auger with a coiled snake cable mounted on a telescoping extension tube. The tube has a rear and a forward handle with a cable lock on top of each handle. By alternately locking/unlocking each handle's cable lock and extending/folding the telescoping extension tube, the user can project the cable down a clogged drain without touching the cable. A second key feature is that the telescoping extension tube prevents kinking of the cable. Turning the auger handle twists the cable's auger tip when a wing screw locks the cable to a rotatable nose on the drum auger.

6 Claims, 10 Drawing Sheets

TELESCOPING DRUM AUGER EXTENSION TOOL

CROSS REFERENCE APPLICATIONS

This application is a non-provisional application claiming the benefits of provisional application No. 62/375,606 filed on Aug. 16, 2016.

FIELD OF INVENTION

The present invention relates to an improved manually operated drum auger used to clear blockage in a drain.

BACKGROUND OF THE INVENTION

U.S. Pat. No. 8,434,186 (2013) to Wildauer et al. is incorporated herein in its entirety by reference. The '186 patent discloses a hand held and hand operated drain cleaning tool with a cable or snake coiled in a drum. A crank is attached to the drum to allow a user to rotate the drum about a support assembly from which a handle depends. The cable extends forwardly of the drum and is extended relative thereto for insertion into a drain to be cleaned and rotates with the drum so as to clear a blockage encountered in the drain. A user withdraws a length of the cable from the drum until a snag in a drain is reached and then a thumbscrew at the forward end of the drum is tightened against the cable so as to preclude unintended displacement of the cable into the drum as the cable is advanced. The drum is then held with one hand and rotated by the other while the user forces the cable into the drain at the same time. When the withdrawn length of the cable has been inserted into the drain, the thumb screw is loosened the cable is held in place and the drum is withdrawn from the drum. The thumbscrew is again tightened and the operation is repeated to displace the newly extended length of the cable to the drain. When the drain cleaning operation is completed, the thumbscrew is loosened and the cable is manually pushed back in the drum by the user. A tubular port is disposed forwardly of the drum and may include a pistol grip type handle extending laterally of the axis of rotation for supporting the drum.

Hand held and hand operated drain cleaning tools are desirable in that they are relatively lightweight, structurally simple, economical to manufacture, and, for all of these reasons, ideal for use in connection with light duty drain cleaning operations such as those encountered in a residence.

A problem with the prior art is that the user must touch the cleaning cable for insertion and removal from the drain. This exposes the user to hazardous wastes. Another problem is the coiling and kinking of the exposed cable during the twisting action used for cleaning the drain. A kinked cable prevents the twisting of the cleaning tip.

What is needed in the art is an extension tool that pushes the cable into the drain without the user's hands touching the cable. What is also needed is a telescoping tube that prevents the kinking of the cable during the twisting of the cable.

The present invention meets these needs with a two handle tool that allows a user to attach a handle clamp onto the cable for inserting or withdrawing the cable into and out of a drain. A telescoping shaft completely encloses the cable from the drain opening to the auger drum, thus preventing any kinking.

SUMMARY OF THE INVENTION

The main aspect of the present invention is to provide a telescoping dual handled extension tube that allows the user to insert or withdraw a coiled snake into and out of the drain without touching the cable.

Another aspect of the present invention is to provide a clamp on the extension tube to be temporarily connected to a drain pipe.

Another aspect of the present invention is to provide a forward force on the spinning tip of the coiled snake by locking the forward handle clutch brake after the user forces the spinning tip against the blockage using the rear handle and telescoping tube. Thus, a forward force is created on the spinning tip by forcing the cable to coil inside the drain pipe, as the user spins the spinning tip using the drain handle. An efficient cleaning action is created combining this forward force with the spinning tip. It is noted that to create this forward force using a prior art '186 patent type device, a helper's third hand would be needed to force the cable forward as the user holds and turns the drum auger using two hands.

Another aspect of the present invention is to provide a squeegee type wiping of the coiled snake as it is removed from the drain.

Other aspects of this invention will appear from the following description and appended claims, reference being made to the accompanying drawings forming a part of this specification wherein like reference characters designate corresponding parts in the several views.

The present invention consists of:

1) Hand crank and drum.
2) Telescoping tube/collapsible pipe
3) Spring loaded rubber clutch-break in each of a forward and rearward handle
4) Rubber/metal quick release adaptor for a drain The plumbing industry is well educated on how to operate and quickly clear a clogged drain. However, with this modification made to a standard drum auger, anyone with average motor skills and even a rudimentary knowledge of plumbing can become a skilled tradesman.

The standard operating procedure of the typical drum auger concept is designed to have the drain cleaning cable to be manually hand fed down the drain line until it reaches an obstruction in the drain line and becomes entangled, caught or snagged in the blockage. The cable begins to spin via a drum crank handle while the tip of the cable will rip and tear at the blockage until the obstruction is free, opening the drain line and allowing the obstruction to travel freely down the drain into your community sewer system. The weakest link in this prior art system is the exposed section of cable, suspended in the air, between the drum auger and the drain line opening. As the cable twists and spins itself deep inside the pipe, the cable will begin to take on the shape of a spring. Since the torque is still building inside the drain line, the cables will wrap the inside of the pipe until a spring like-cable is exiting the pipe with nothing to contain its coiled, spring-loaded condition. Because the cable is under tension, it will take the path of least resistance, and curl around itself outside of the drain. Since there is no structure restricting the cable to continue the spring like momentum already built up, the cable move freely in the open space and spins itself back in the opposite direction until mediocre balance is achieved. This creates a twisted cable, usually with noticeable kinks in the cable. The kinks render the auger cable useless for future uses.

The primary function of the present invention drain cleaner is a telescoping tube. This tubing will extend and collapse into itself. As the cable is being driven into the drain line, the telescoping tube will allow the user get into to a comfortable position (resting outside of the cabinet) without needing to be propped up under a sink/cabinet/vanity or slouched over a bathtub. The telescoping tubing will extend the drain line opening up to 24" away from the p-trap. There are numerous applications and accessories that can be used to accompany the present invention to meet any secondary drain need, i.e., bathtubs, shower stalls, p-traps, or cleanouts. With the telescoping tube, the cable retains the momentum and never loses its spring-like shape to maintain the applied torque for the entire distance between the user, the drum auger and the blockage.

In order to make the cable travel down into the drain pipe, the user never needs to get his or her hands dirty. The secondary function of the present invention is the locking spring loaded rubber clutch break. The easily manipulated trigger-like clutch break will have two functions of its own. Predominantly, it will grip the cable with the clutch break rubber pads attached to the trigger which is located in the handle on the drum auger and also in the forward handle of the middle section of the telescoping tubing. This allows the user to simply push the drum auger forward, towards the drain, displacing the cable that was in the telescoping tubing into the drain, by locking and unlocking the clutch brakes.

With an enclosed system the cable will travel forward freely with the auger as the user is pushing the auger in the direction of the drain pipe. This averts the user from coming into contact with the potentially diseased infested internal parts of the auger. The cable will travel freely until it meets an obstruction. Blockages can come in numerous forms. They can be formed by eroding pipe, incorrectly installed fittings and even due to sludge build-up in the pipe. As an obstacle is encountered, the user must engage the clutch break by pressing the trigger, leaving the rubber clutch break gripping the cable, and spin the drum while extending outer handle toward the drain pipe. As you push the cable forward, the spinning drum will reposition the spearhead tip of the cable in the drain and jump/flop around obstacles in the pipe until it is free from what was impeding its further penetration. After full extension of the tubing is reached, another section of cable must be latched onto and sent into the drain. To get a new bite, the user would release the trigger to disengage the clutch brake on the outer handle to retract his arm back up against the auger, extending the telescoping tubing before reengaging the clutch break and pushing again.

A rubber washer at the tip of the forward tube wrings out the debris on the cable as it is retracted.

The present invention will make for simple and improved housekeeping. The user would not need to touch the cable since the entire system is now an enclosed environment thanks to the 1½" rubber quick release adaptor. It will keep the liquids from spraying black water waste around the work station or on the user.

Black water waste is a serious risk to health and illness. Black water waste is a related cause of to the growth of black mold. Any section of a drain that is connected with a public waste infrastructure and is not sealed by a vapor lock (p-trap) is considered black water waste and must be dealt with appropriately. Gastroenteritis, E-Coli, Hepatitis B, Cholera are a few of many diseases and parasites commonly found in community waste sewage system. The waste infrastructure is interconnected to everything, which means that just under your toilet is every other building/facility's water closets that are on the same shared community waste sewage system. Whatever your neighbor flushes down his sewer is potentially just inches under your commode. And since it's all considered contaminated, there are no degrees of contamination as it is all considered black water waste.

The cable is dense so the standing water in the drain cannot be absorbed into it; so the water level will rise as more cable is fed into the sewer system. The 1½" quick release rubber adaptor is the simplest and quickest method of attaching the leak-proof telescoping tubing to the drain line. This prevents the spilling and/or accumulation of expunged black water waste in undesirable locations (like your clothing or hands), as the cable is fed into the pipe; causing the water to rise.

The present invention is a self-contained enclosed telescoping tube style drum auger which connects the auger to the drain, where there are NO fussy messes and NO cleaning hassles! Once you have completely open a clogged drain, take it outside and clean it with a water hose in preparation for a tidy storage. Storage in a specific, typically dirty, location is no longer necessary. With the isolation and black water waste containment, your plumbing tools can be stored in any cleaning supply storage.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
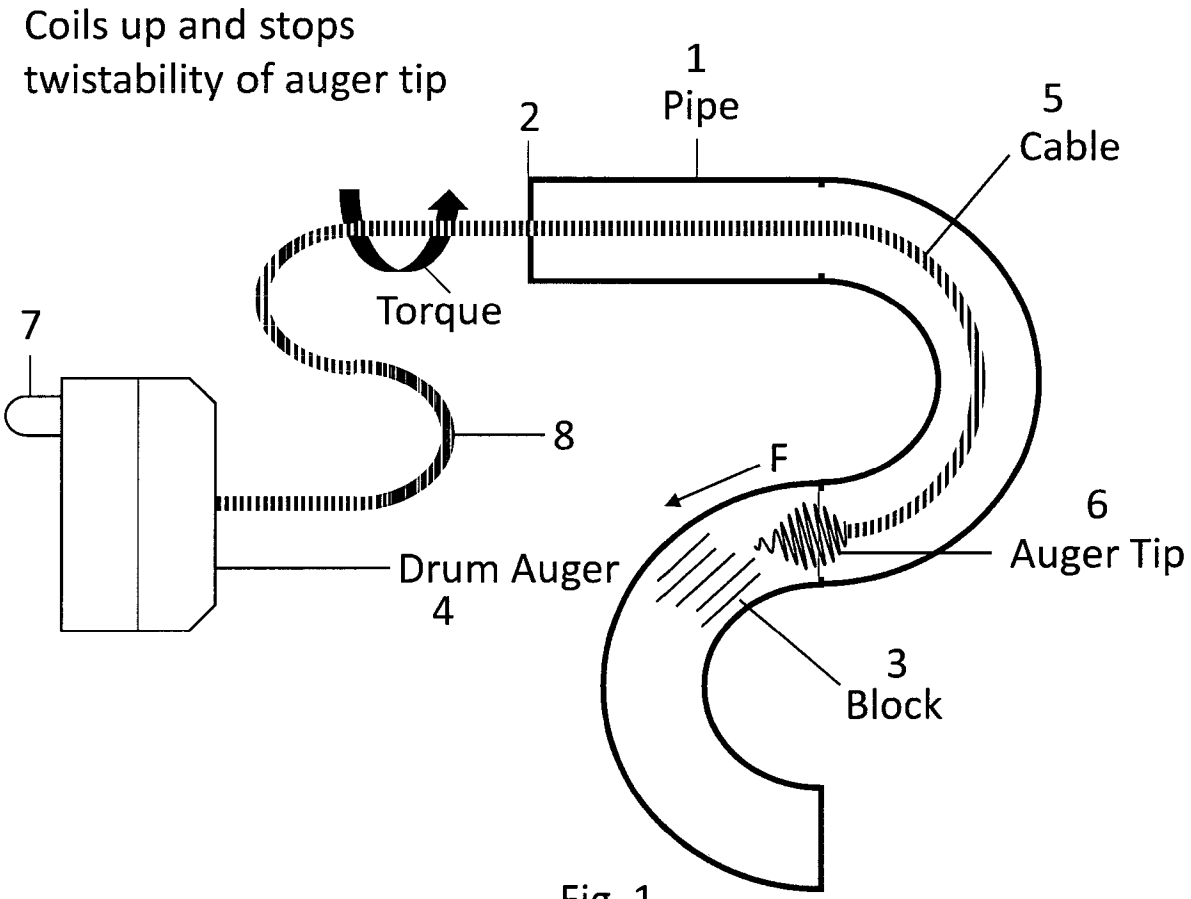
Fig. 1 (Prior Art)
FIG. 1 (Prior Art) is a side elevation view of a drum auger in operation.

Referring first to FIG. 1 a drain pipe 1 has an open end 2 and a blockage 3. A prior art drum auger 4 has a cable 5 with an auger tip 6. U.S. Pat. No. 8,434,186 shows an example of a prior art drum auger and is incorporated herein by reference. The handle 7 is rotated thereby rotating the cable as shown by arrow TORQUE. Thus, the auger tip 6 rotates to clear the blockage 3. The only force F put on the auger tip 6 is provided by the cable 5 as pushed in by the drum auger 4. However, the cable 5 coils up into a coil 8. This limits the force F capable of pushing against blockage 3. This coil 8 also inhibits the rotation TORQUE of the cable 5.

Figure 2:
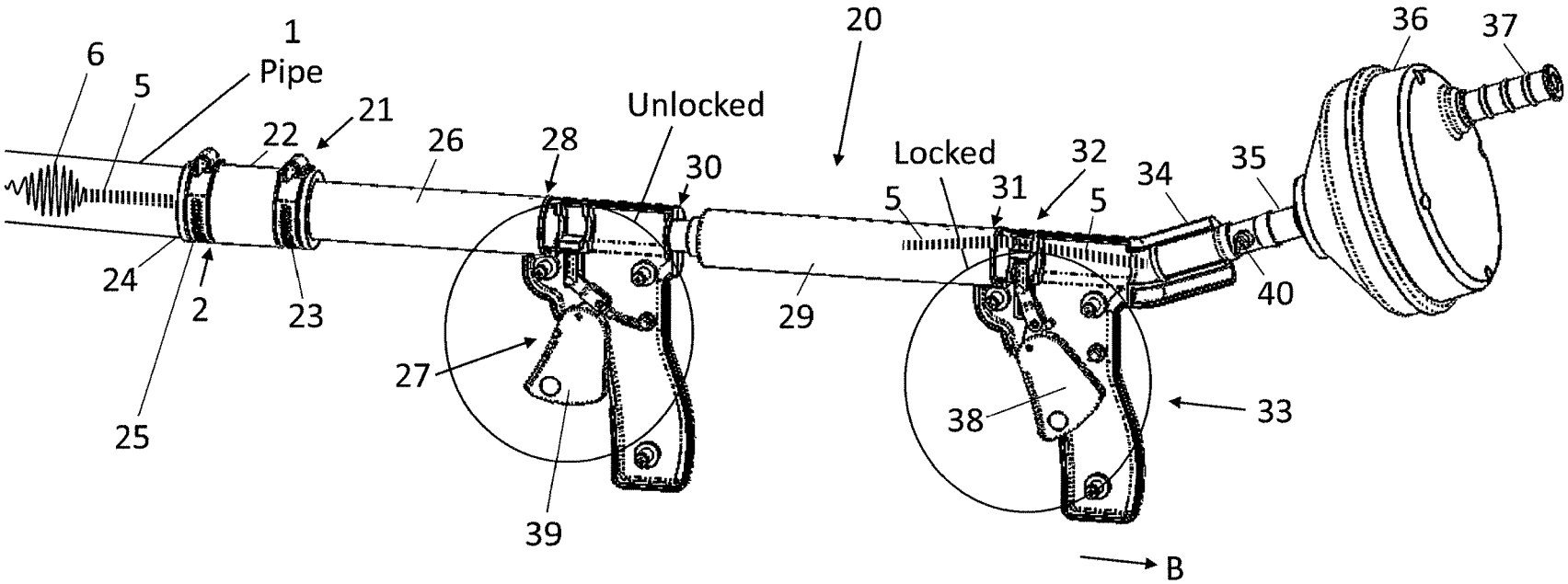
FIG. 2 is a side elevation view of the telescoping drum auger in the closed mode attached to a drain pipe.

Referring next to FIG. 2 a telescoping drum auger 20 has a distal end 21 with a (rubber) connector 22 that has a hose clamp 23 attaching the connector 22 to the distal end 21 of the telescoping drum auger 20. The working end 24 of the connector 22 has a hose clamp 25 for attachment to the open end 2 of the drain pipe 1.

A forward pipe 26 does not telescope. The forward pipe 26 attaches to the forward clutch handle 27 at its forward end 28. A telescoping pipe 29 attaches to a rear end 30 of the forward clutch handle 27. A rear end 31 of the telescoping pipe 29 attaches to a front end 32 of a rear clutch handle 33.

A rear end of the rear clutch handle 33 has a neck 34 to receive a nose 35 of a drum auger 36. The drum auger 36 has a handle 37 to twist the cable 5.

The rear clutch handle 33 is shown with the trigger 38 activated which locks the cable 5 against the inside top of the rear clutch handle 33. The handle 39 of the forward clutch handle 27 is released. Thus, the cable 5 can slide back and forth in the forward clutch handle 27.

A user can pull the rear clutch handle back in direction B to pull the cable 5 out of the drain pipe 1. During insertion of the cable 5 the user would extend the telescoping pipe 29, then unlock the forward clutch handle 27, then lock the rear clutch handle 33, then shove the cable 5 into the open end 2 of drain pipe 1. The cable would unwind out of the drum auger 36. No coiling of the cable 5 is possible because the telescoping drum auger 20 completely surrounds the cable 5. Once the auger tip 6 hits the blockage 3, the user can exert a strong force F against the blockage 3 because the connector 22 holds the telescoping drum auger 20 firmly in place.

Figure 3:
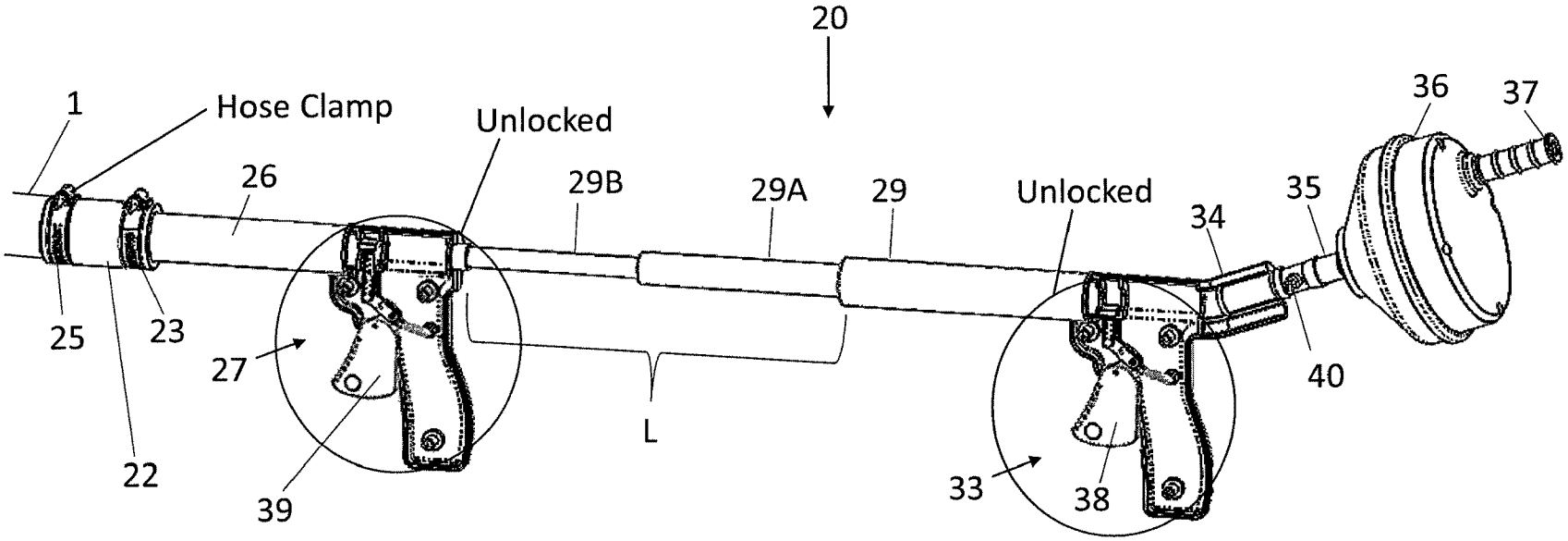
FIG. 3 is the same view as FIG. 2 with the telescoping drum auger in the extended mode.

Referring next to FIG. 3 both triggers are unlocked. The user can turn handle 37 and twist the cable 5 to turn the auger tip 6. The telescoping pipe 29 is shown extended exposing inner pipes 29A and 29B. The turning of the auger tip 6 could also be done with the telescoping pipe 29 closed. When twisting the cable 5 using the handle 37, the wing screw 40 must be fastened against the cable 5. For all insertion and extraction steps, the wing screw 40 is released from the cable 5.

Figure 4:
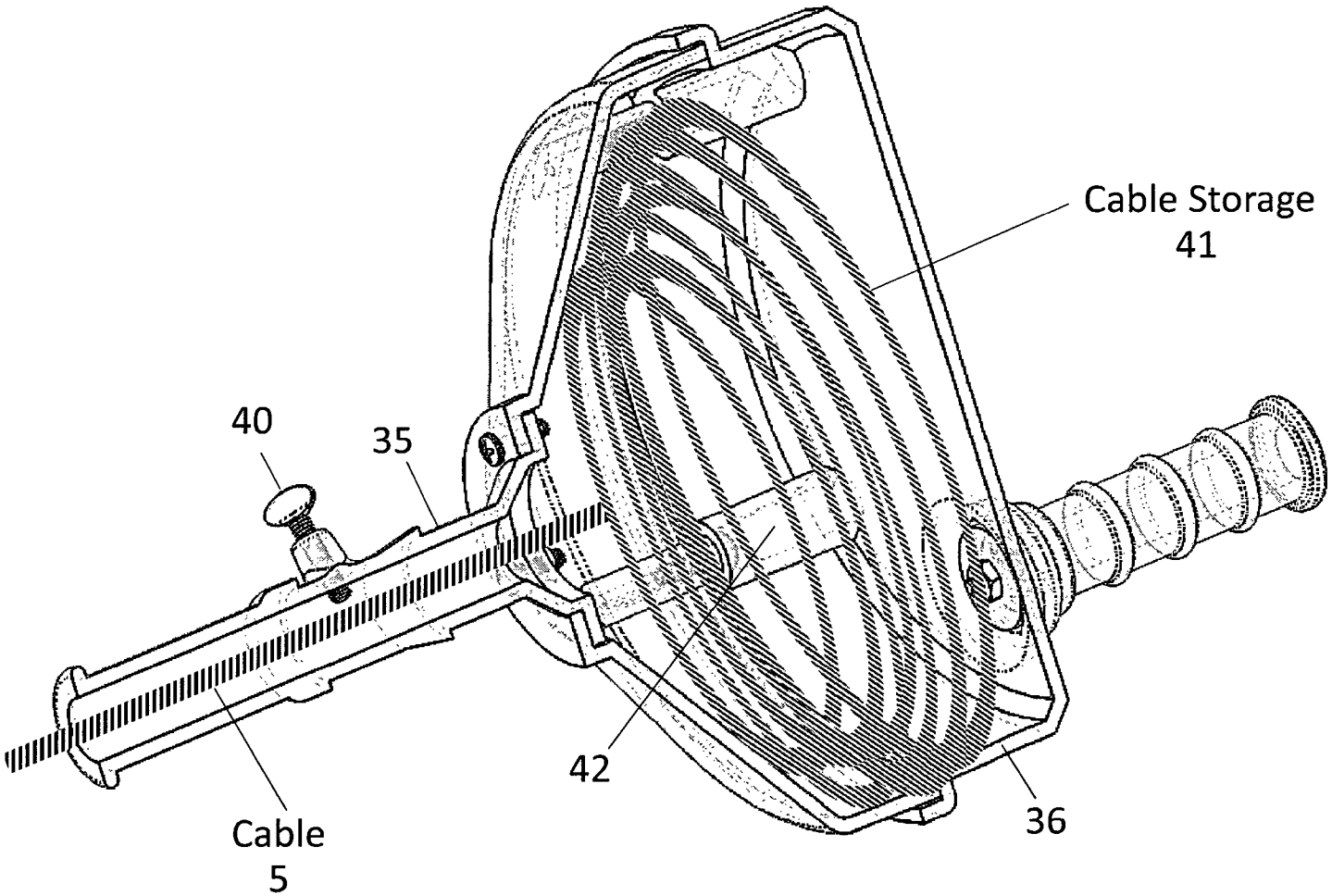
FIG. 4 is a cutaway view of the drum with the cable wound around the reel.
Figure 5:
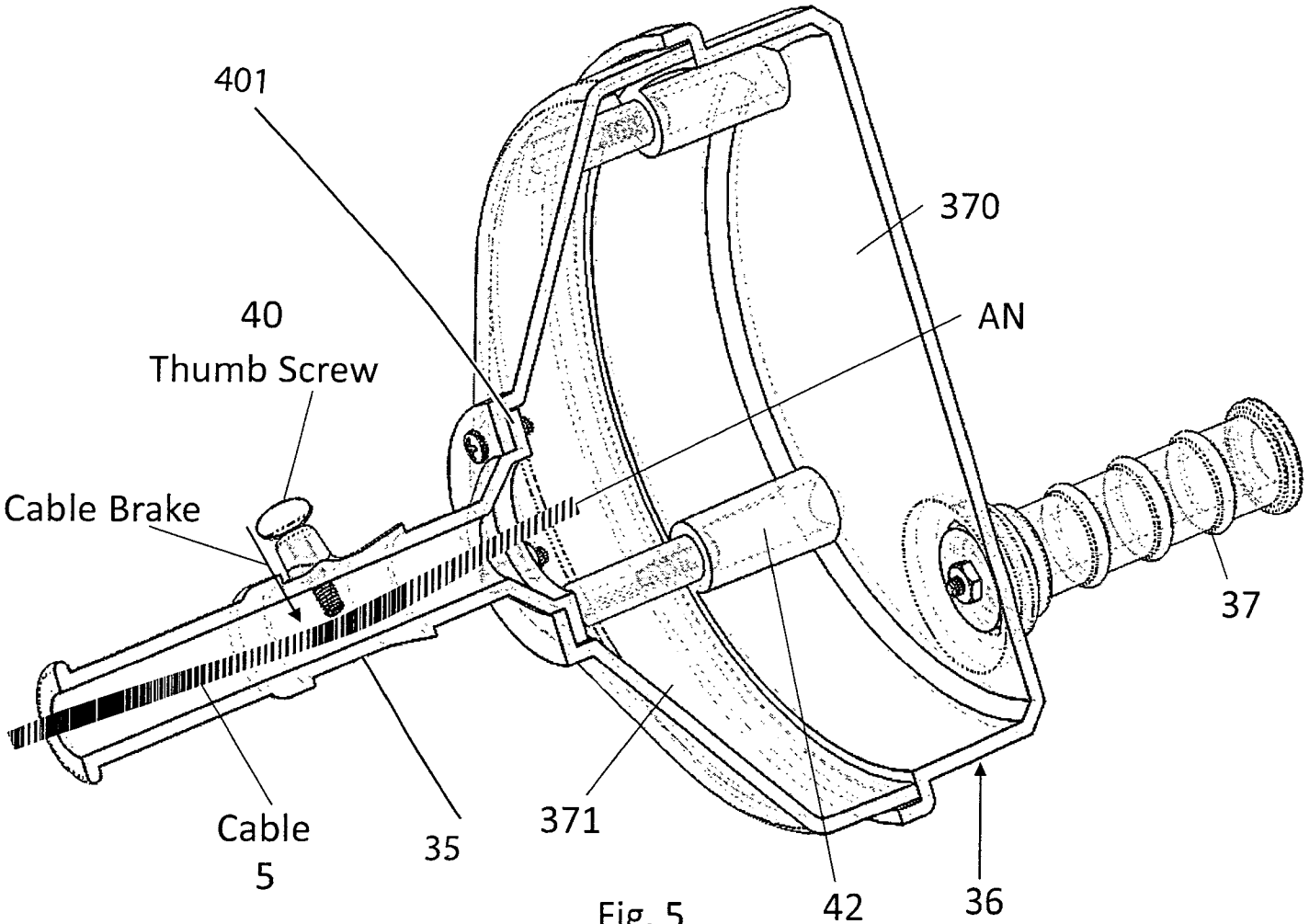
FIG. 5 is the same view as FIG. 4 with the cable extended.

Referring next to FIGS. 4, 5 the cable 5 is wound into a coil so as to be in a storage mode 41. The cylinders 42 support the handle end 370 to rotate around cable 5 as it is anchored at AN to handle end 370 at the fixed hub 371. Thus, turning handle 37 twists the cable 5 by rotating the handle end 370 which rotates the cylinder 42 which rotates the nose 35. When the wing screw 40 locks the cable 5 to the nose 35, the cable 5 is twisted when the handle 37 is rotated.

Figure 6:
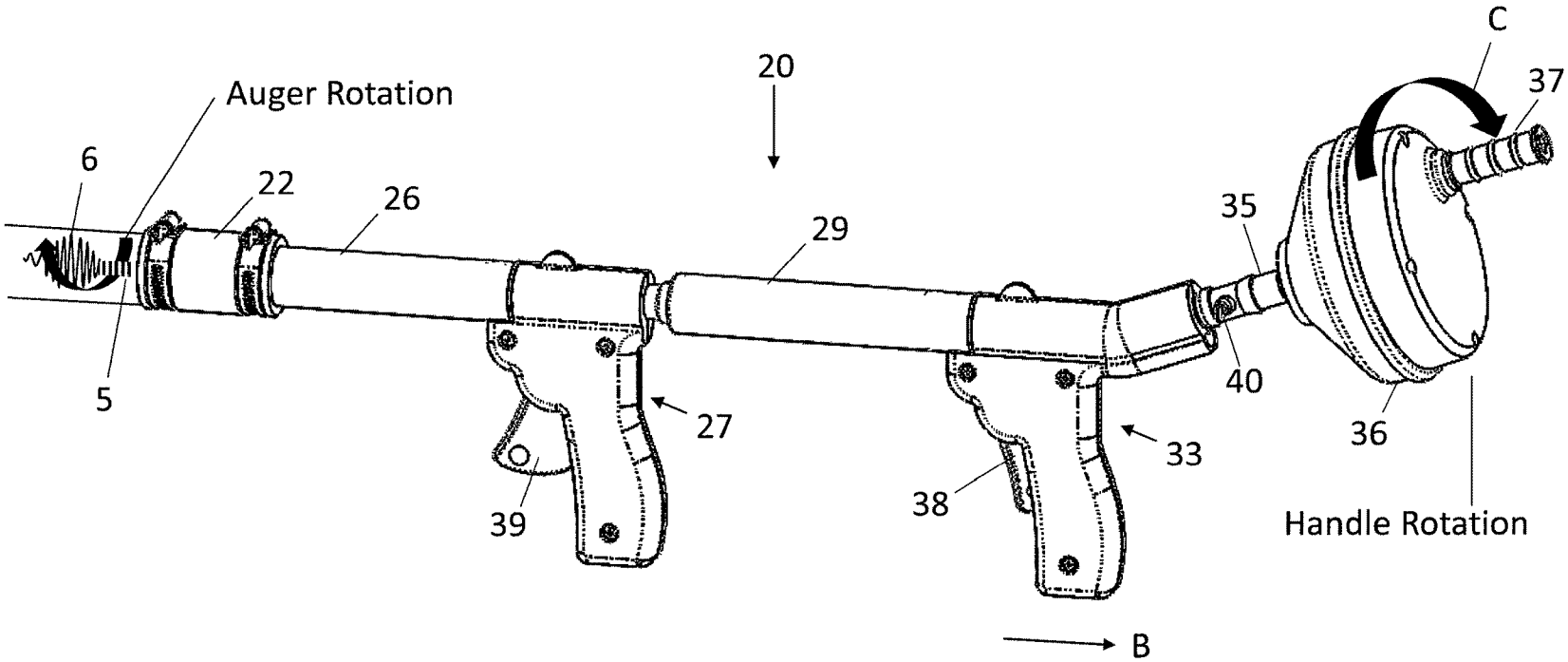
FIG. 6 is a side elevation view of the telescoping drum auger in operation.

Referring next to FIG. 6 the user just before this step has twisted the auger tip 6 clockwise by turning handle 37 clockwise shown by arrow C. At that time rear clutch handle 33 was unlocked and wing screw 40 was locked against cable 5. In this view the rear clutch handle 33 is locked, and the telescoping pipe 29 is closed. The user is ready to pull the rear clutch handle back in direction B to pull the auger tip 6 out of the drain pipe 1. Once this step is done, the user turns the handle 37 counter clockwise to reel the cable back into a coil 41 as shown in FIG. 4. The insertion and extraction steps are done in increments of the extension length L (FIG. 3) which is nominally about one foot.

Figure 7:
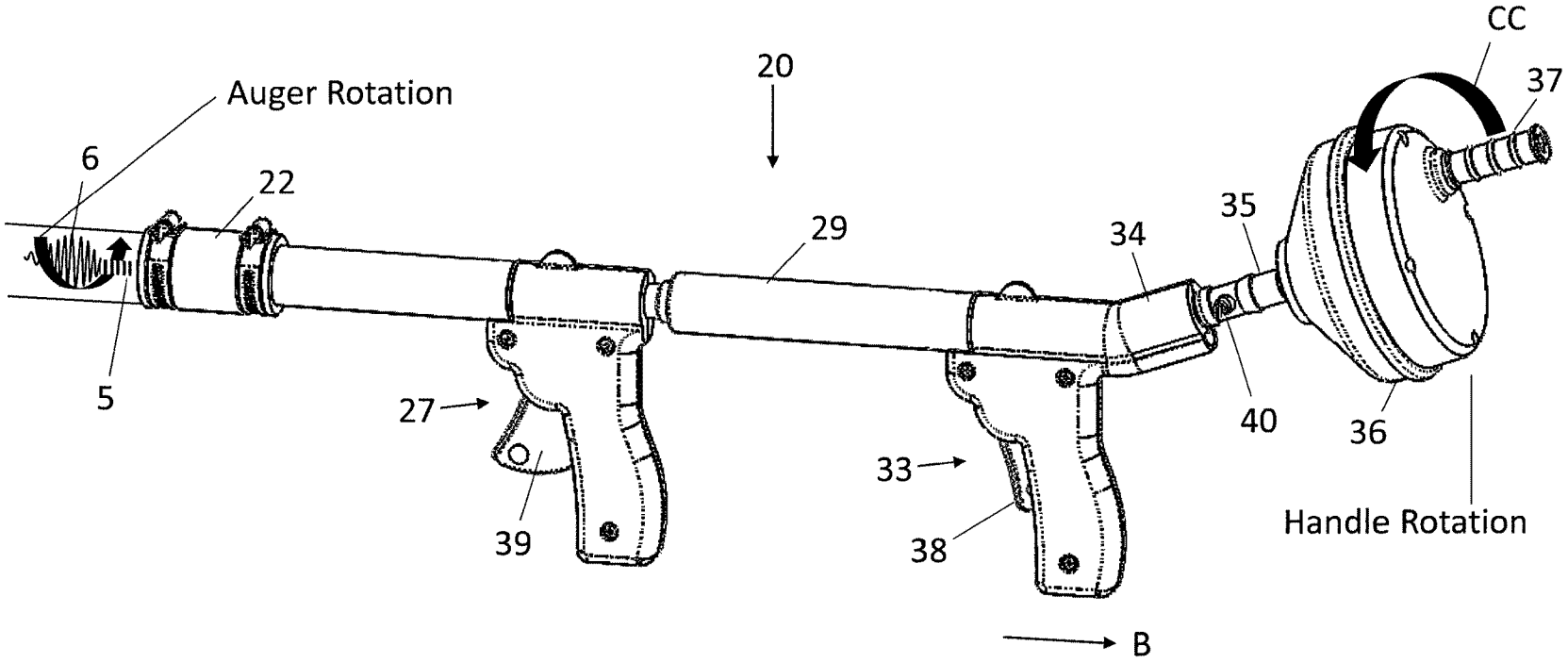
FIG. 7 is the same view as FIG. 6 with the cable being extracted.

Referring next to FIG. 7 handle 37 is turned counter-clockwise cc, thus turning auger tip 6 in the same direction. Rear clutch handle 33 would need to be unlocked for any twisting of cable 5. As shown rear clutch handle 33 is locked. By pulling rearward in direction B the auger tip 6 would be extracted from the drain pipe 1.

Figure 8:
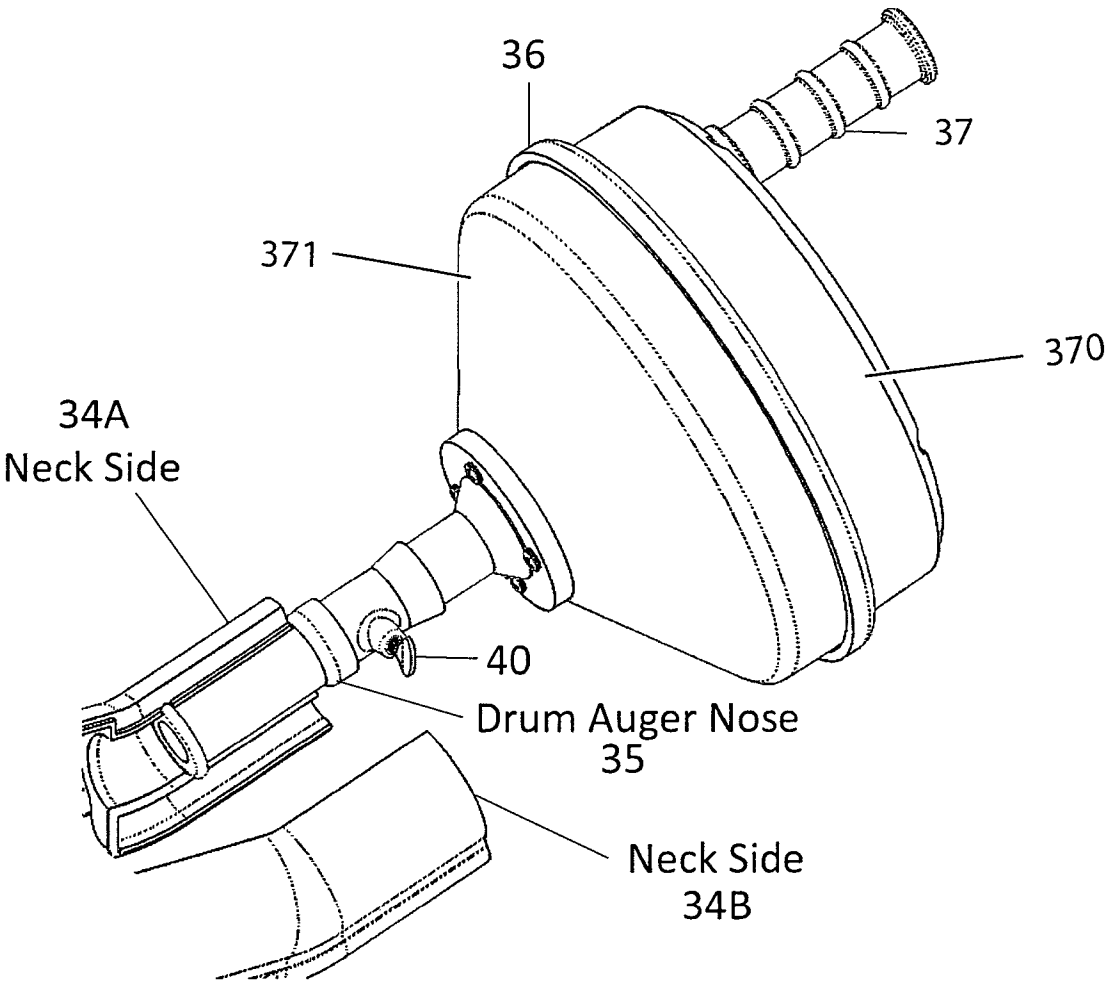
FIG. 8 is a side perspective cutaway view of the drum auger attachment to the telescoping assembly.

Referring next to FIG. 8 the neck sides 34A and 34B of neck 34 are shown exploded from drum auger nose 35.

Figure 9:
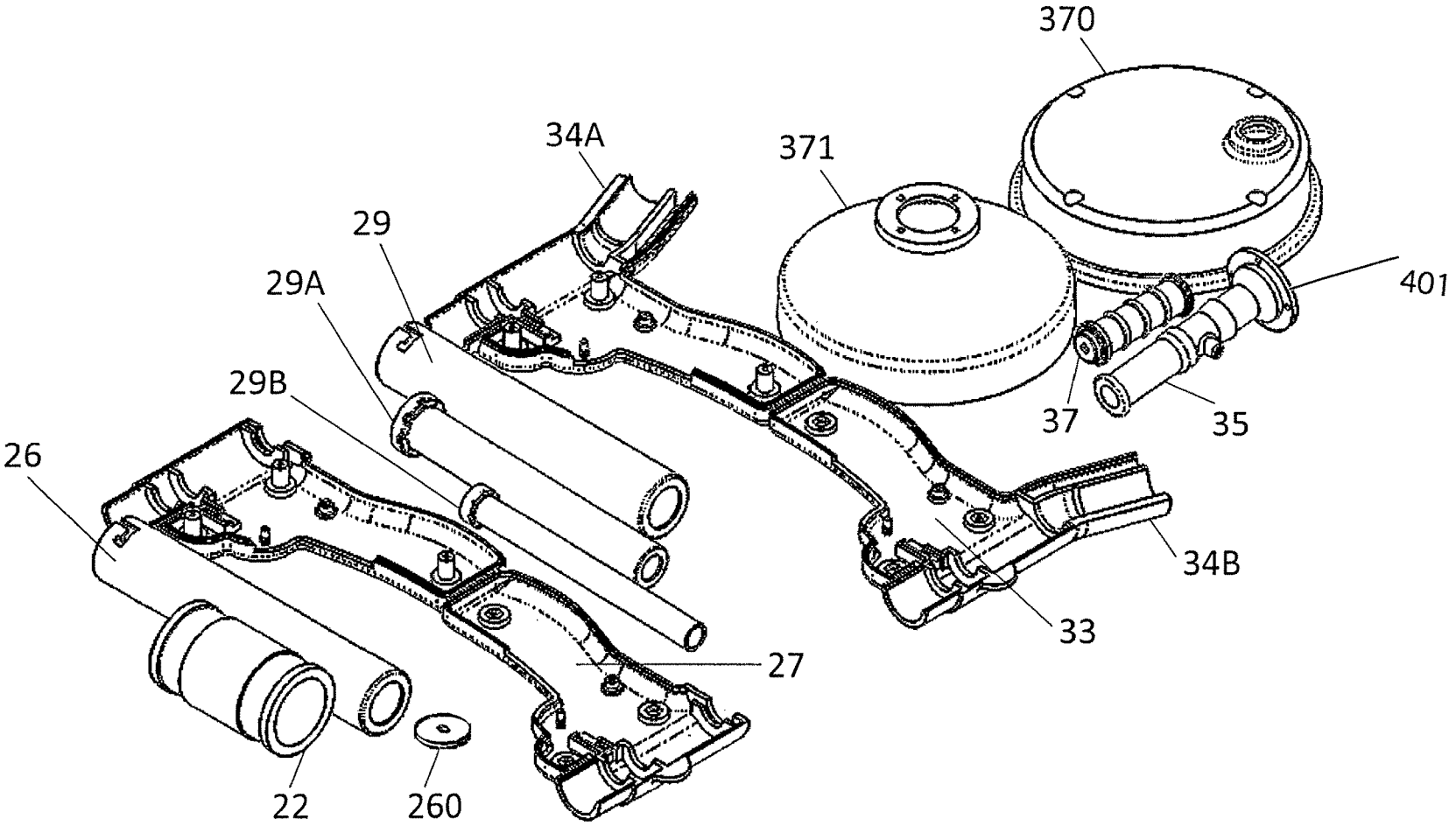
FIG. 9 is an exploded view of the telescoping drum auger.

Referring next to FIG. 9 the preferred manufactured exploded view is shown. The miscellaneous connecting screws and washers are not shown. A washer 260 wrings out the debris off the cable 5 during retraction. Preferably all parts are plastic except the metal cable 5. The base 401 of nose 35 is rotated by cylinder 42 shown in FIG. 5.

Figure 10:
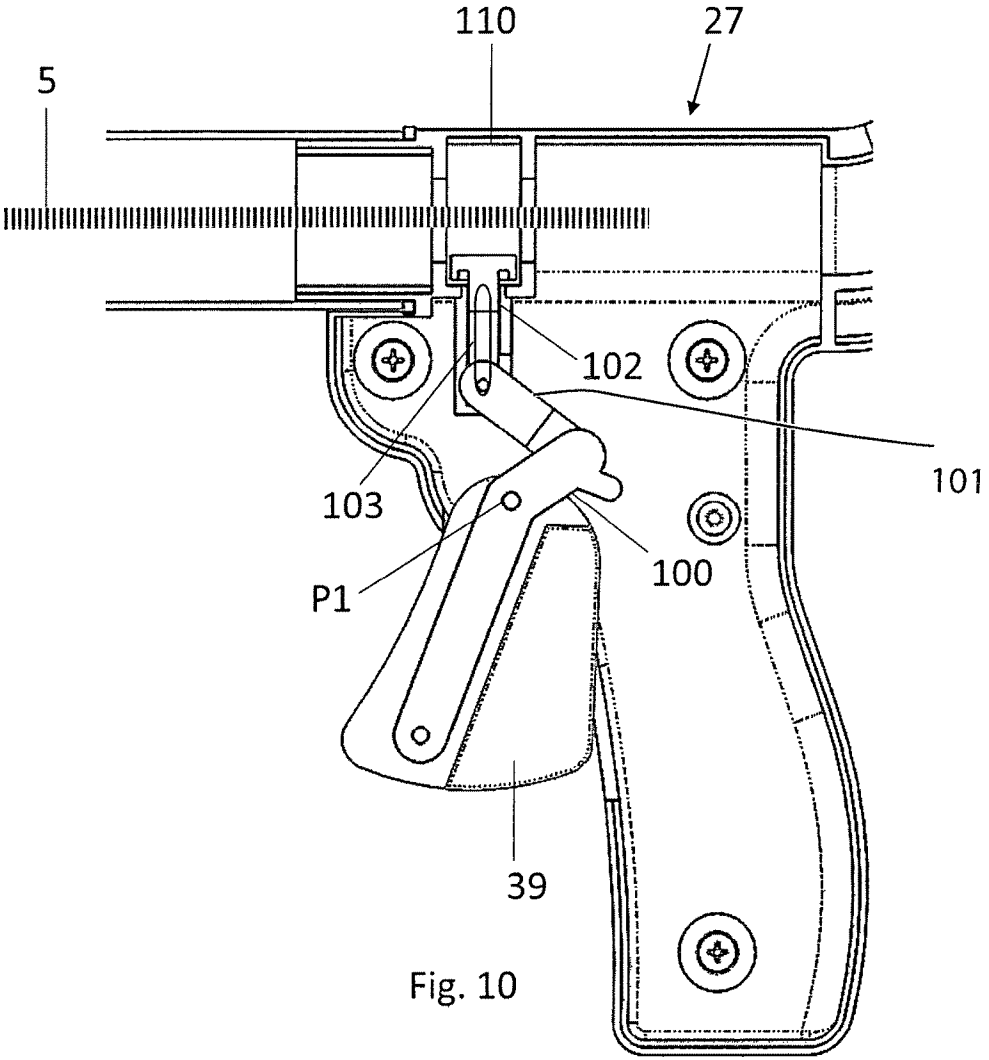
FIG. 10 is a cutaway view of the locking clutch in the open mode.

Referring next to FIG. 10 the front clutch handle 27 is shown, wherein the operation of the rear clutch handle is identical. Trigger 39 pivots at P1 so that pulling trigger 39 straightens arms 100, 101 and clutch 102 is driven up in slot 103. This clutch 102 locks the cable 5 up against the inner top at point 110, when the trigger 39 is pulled.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A drain cleaner comprising:

a drum auger having a frame for rotatably holding a drum;

a cable affixed to the drum;

wherein rotating a drum handle on the drum twists the cable and a nose on the drum auger when a wing screw on the nose locks the cable to the nose;

a rear clutch handle having a manually activated trigger which locks the cable at a top segment of the rear clutch handle;

said rear clutch handle having a rear neck to receive the nose;

a telescoping pipe attached to a front of the rear clutch handle;

a forward clutch handle a distal end of the telescoping pipe attached to a rear of the forward clutch handle;

said forward clutch handle having a manually operated trigger which locks the cable at a top segment of the forward clutch handle;

said forward clutch handle having a connector to engage a drain;

wherein releasing the forward clutch handle while locking the rear clutch handle and releasing the wing screw from the cable and moving the rear clutch handle forward inserts an auger tip of the cable into the drain; and wherein rotating the drum handle with the wing screw locked on the cable causes the auger tip to rotate.

2. The drain cleaner of claim 1, wherein the triggers of the forward and rear clutch handles each further comprise a pivot with an upper fixed arm attached to a movable upper arm that drives a clutch upward to lock the cable at a top inner point of the respective clutch handle.

3. The drain cleaner of claim 1, wherein the connector on the forward clutch handle further comprises a pipe and a hose clamp.

4. The drain cleaner of claim 1, wherein rotating the drum handle counter clockwise, with the wing screw and both clutch handles unlocked, winds the cable around the drum.

5. The drain cleaner of claim 3, wherein the pipe further comprises a soft washer that encircles the cable, thereby removing debris from the cable during extraction of the cable from the drain.

6. The drain cleaner of claim 1, wherein the nose further comprises a rotatable base mounted in a fixed member of the frame, wherein a cylinder connects the rotatable base to a rotatable rear drum handle base from which the handle projects.

* * * * *